US010551106B2

(12) United States Patent
Pfister et al.

(10) Patent No.: US 10,551,106 B2
(45) Date of Patent: Feb. 4, 2020

(54) REFRIGERATION SYSTEM USING EMERGENCY ELECTRIC POWER

(71) Applicant: Heatcraft Refrigeration Products LLC, Stone Mountain, GA (US)

(72) Inventors: Steven C. Pfister, Dunwoody, GA (US); Douglas Samuel Cole, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 107 days.

(21) Appl. No.: 15/636,018

(22) Filed: Jun. 28, 2017

(65) Prior Publication Data

US 2019/0003756 A1 Jan. 3, 2019

(51) Int. Cl.
*F25B 49/02* (2006.01)
*F25B 27/00* (2006.01)

(52) U.S. Cl.
CPC ..... *F25B 49/022* (2013.01); *F25B 27/00* (2013.01); *F25B 2400/0403* (2013.01);
(Continued)

(58) Field of Classification Search
CPC ..... H01H 2300/018; H02J 1/10; H02J 2003/001; H02J 2009/007; H02J 3/005;
(Continued)

(56) References Cited

U.S. PATENT DOCUMENTS 4,831,835 A * 5/1989 Beehler ..... F25B 41/04 62/196.1
6,067,482 A * 5/2000 Shapiro ..... F25B 49/02 700/286
(Continued)

FOREIGN PATENT DOCUMENTS

KR 101682553 B1 12/2016
WO 2015056403 A1 4/2015
(Continued)

OTHER PUBLICATIONS

European Patent Office, Extended European Search Report, Application No. 18177478.7, dated Nov. 19, 2018, 7 pages.

*Primary Examiner* — Edward F Landrum
*Assistant Examiner* — Chang H. Park
(74) *Attorney, Agent, or Firm* — Baker Botts L.L.P.

(57) ABSTRACT

In certain embodiments, a refrigeration system comprises an emergency electric power supply configured to supply power to at least one motor drive of the system. The system comprises a power switch coupled to the emergency electric power supply, a tank configured to store a refrigerant, a first compressor configured to compress the refrigerant of the tank, and a controller coupled to the power switch and first compressor. The controller may receive an indication from the power switch that the system is using the emergency electric power supply, and in response to receiving the indication from the power switch that the system is using the emergency electric power supply, operate the system in a first power outage mode. The controller may determine an amount of power to supply to the first compressor based on the first power outage mode and transmit a signal to instruct the first compressor to turn on.

20 Claims, 4 Drawing Sheets

(52) U.S. Cl.
CPC ..... *F25B 2500/07* (2013.01); *F25B 2600/024* (2013.01); *F25B 2700/15* (2013.01)

(58) Field of Classification Search
CPC ..... H02J 7/34; H02J 9/00; H02J 9/04; H02M 1/10; H02S 40/38; Y02E 10/566; F25B 2400/0403; F25B 2500/07; F25B 2600/024; F25B 27/00; F25B 2700/15; F25B 49/022; Y02B 90/222
See application file for complete search history.

(56) References Cited

U.S. PATENT DOCUMENTS

2014/0105757 A1* 4/2014 Maass ..... F04C 28/00 417/44.1
2014/0139122 A1* 5/2014 Valois ..... H05B 33/0851 315/165
2016/0054041 A1* 2/2016 Choi ..... F25B 5/02 62/115

FOREIGN PATENT DOCUMENTS

WO 2017073433 A1 5/2017
WO WO-2017073433 A1 * 5/2017 ..... F02C 1/04

* cited by examiner

REFRIGERATION SYSTEM USING EMERGENCY ELECTRIC POWER

TECHNICAL FIELD

This disclosure relates generally to a refrigeration system. More specifically, this disclosure relates to a refrigeration system using emergency electric power, for example, during a power outage.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems control the temperature and pressure of refrigerant as it moves through the refrigeration system. When the system suffers from a power outage, the system can no longer refrigerate the enclosed space or keep its components cool. If heating occurs, this may create issues with the components that may damage the system or degrade system performance.

SUMMARY

In certain embodiments, a refrigeration system comprises an emergency electric power supply configured to supply power to at least one motor drive of the system. The system further comprises a power switch coupled to the emergency electric power supply, a tank configured to store a refrigerant, a first compressor configured to compress the refrigerant of the tank, and a controller, which is coupled to the power switch and the first compressor. The controller may receive an indication from the power switch that the system is using the emergency electric power supply, and in response to receiving the indication from the power switch that the system is using the emergency electric power supply, operate the system in a first power outage mode. The controller may determine an amount of power to supply to the first compressor based on the first power outage mode and transmit a signal to instruct the first compressor to turn on.

In one embodiment, a controller for a refrigeration system comprises an interface, a memory, and a processor. The memory is operable to store a first power outage mode. The interface is configured to receive an indication from the power switch that the system is using the emergency electric power supply. The processor may, in response to the interface receiving the indication from the power switch that the system is using the emergency electric power supply, operate the system in a first power outage mode. The processor may further determine an amount of power to supply to the first compressor based on the first power outage mode and then the interface may transmit a signal to instruct the first compressor to turn on.

In one embodiment, a non-transitory computer readable medium comprising instructions which, when executed by a computer, cause the computer to receive an indication from a power switch that the system is using an emergency electric power supply, and in response to receiving the indication from the power switch that the system is using the emergency electric power supply, operate the system in a first power outage mode. The instructions may further cause the computer to determine an amount of power to supply to the first compressor based on the first power outage mode and transmit a signal to instruct the first compressor to turn on.

Certain embodiments of the present disclosure may provide one or more technical advantages. For example, allowing the system to operate in a first power outage mode allows the system to prevent the refrigerant in the tank from becoming over pressurized, thus reducing the risk of damage during a power outage. As another example, the first power outage mode allows the system to use its main equipment during a power outage mode, rather than having the system use an additional back up system and components. This solution reduces the number of additional parts required in the system, thus creating a simpler system that utilizes fewer resources and requires less routine maintenance for its back up components.

Certain embodiments of the disclosure may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Cooling systems may cycle a refrigerant to cool various spaces. For example, a refrigeration system may cycle refrigerant to cool spaces near or around refrigeration loads. In certain installations, such as at a grocery store for example, a refrigeration system may include different types of loads. For example, a grocery store may use medium temperature loads and low temperature loads. The medium temperature loads may be used for produce and the low temperature loads may be used for frozen foods. Refrigeration systems require a power supply in order to operate. In the case of a power outage, refrigerants (e.g., carbon dioxide) may start gaining heat such that the refrigerant pressure may rise and exceed the design pressure of the overall refrigeration system. The refrigeration system generally must be vented to the atmosphere in such a situation.

In order to avoid venting the refrigerant, refrigeration systems may include backup systems with additional motor drives (e.g., an extra set of compressors only used during a power outage) to keep the refrigerant cool and at a low pressure. Including any backup devices, however, may create a more complicated refrigeration system, requiring additional expenses for duplicate parts that are only used in power outages. These additional parts may require routine maintenance to ensure they are operable during a power outage. Thus, there is a desire for a simple refrigeration system that may operate during a power outage, while limiting the number of additional parts required.

Figure 1:
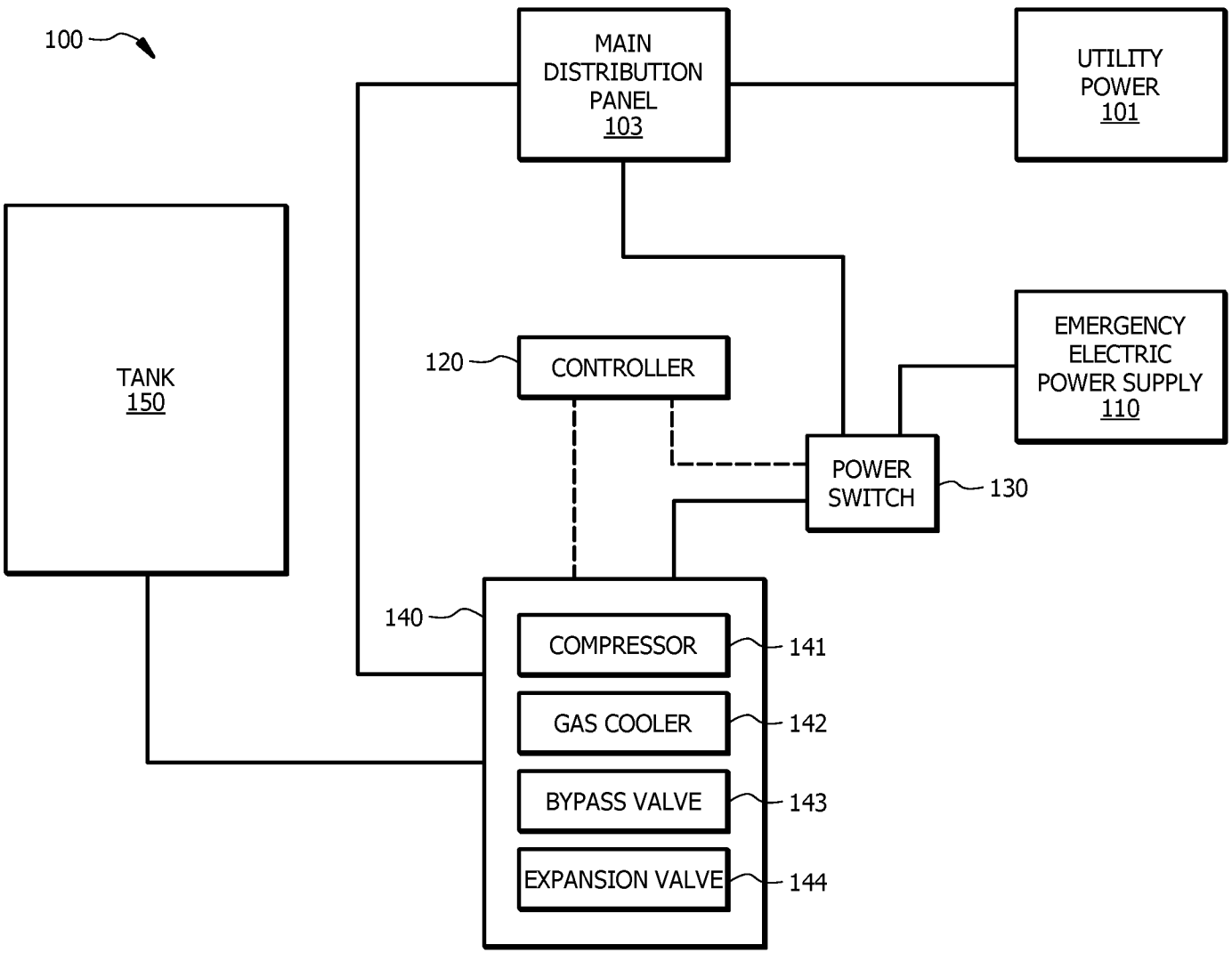
FIG. 1 is a block diagram illustrating an example refrigeration system according to some embodiments.
Figure 2:
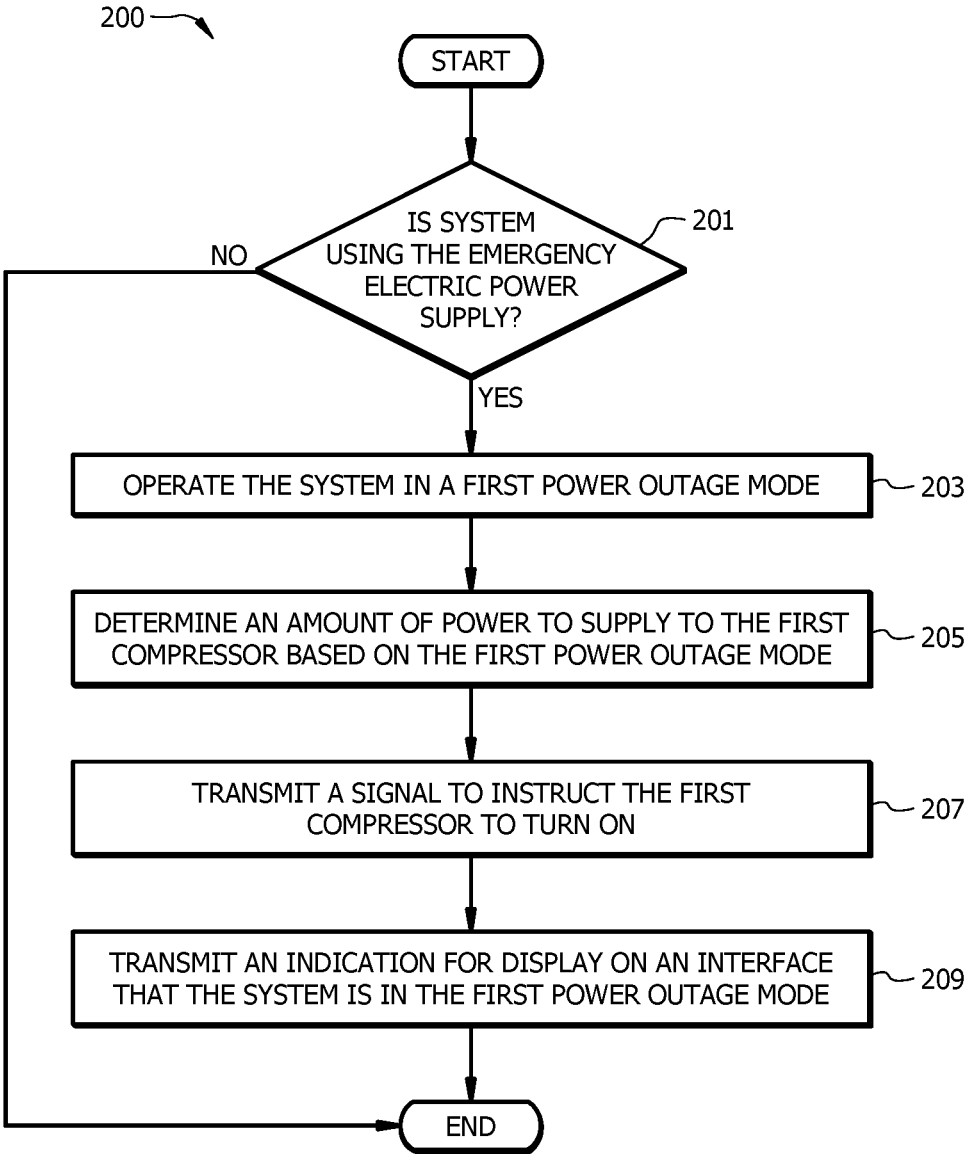
FIG. 2 is a flowchart illustrating a method of operating the example refrigeration system of FIG. 1.
Figure 3:
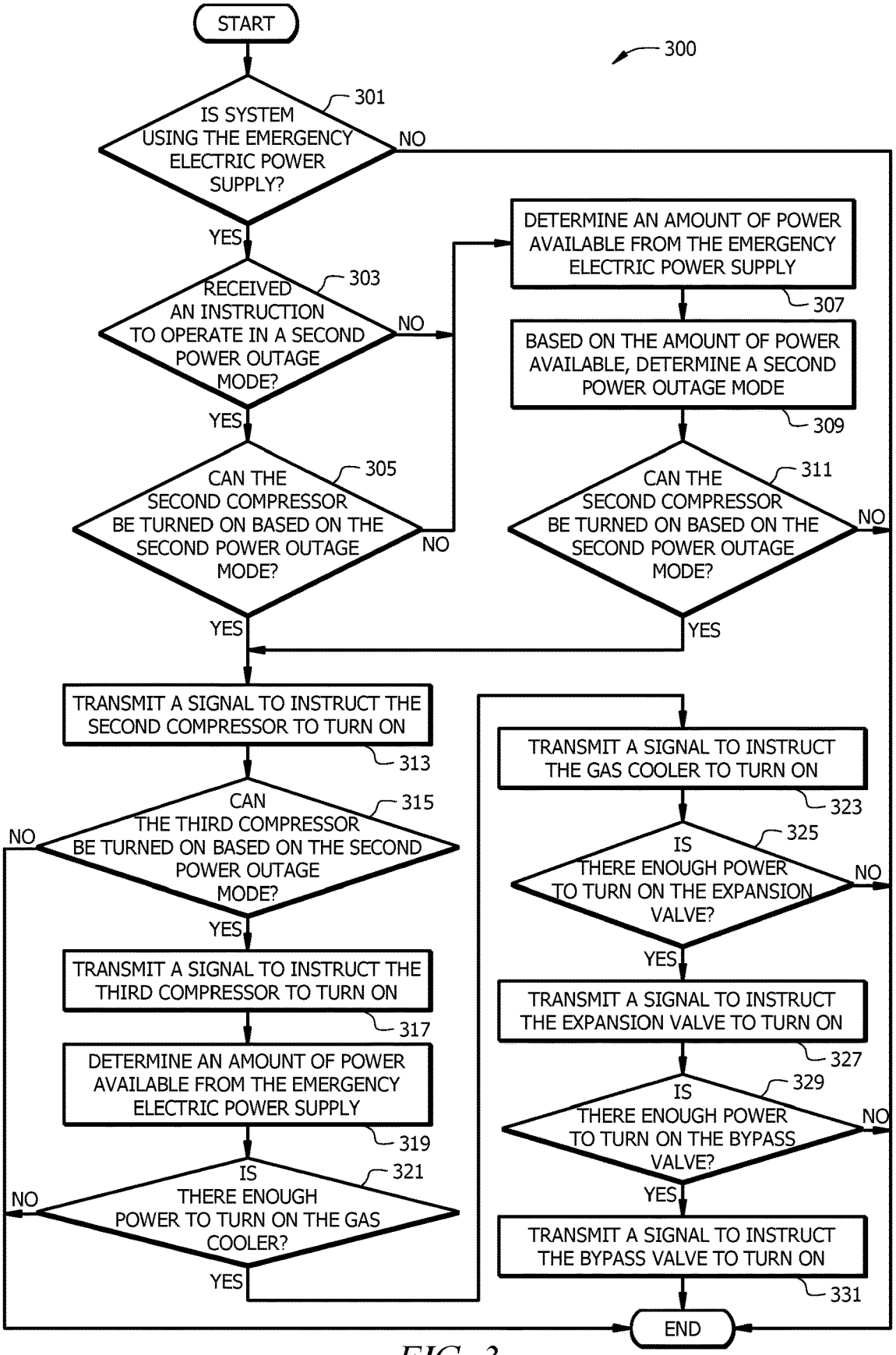
FIG. 3 is a flowchart illustrating a method of operating the example refrigeration system of FIG. 1.

Embodiments of the present disclosure and its advantages are best understood by referring to FIGS. 1 through 3 of the drawings, like numerals being used for like and corresponding parts of the various drawings.

FIG. 1 is a block diagram illustrating example refrigeration system 100 according to some embodiments. Refrigeration system 100 includes utility power 101, main distribution panel 103, emergency electric power supply 110, power switch 130, controller 120, motor drives 140, one or more compressors 141, and tank 150.

During regular use, utility power 101 provides power to system 100, allowing it to perform cooling and refrigeration. Main distribution panel 103 provides power from utility power 101 to any components of system 100 that require power to function, for example any of the motor drives 140 (e.g., compressor 141). In some embodiments, main distribution panel 103 provides power directly to one or more motor drives 140. In some embodiments, main distribution panel 103 may provide power through power switch 130 to one or more motor drives 140. When there is a power outage, utility power 101 may be inaccessible such that system 100 may be limited on the refrigeration it can provide. Further, as discussed above, if no power is supplied to system 100, refrigerants in tank 150 may start gaining heat such that the refrigerant pressure may rise and exceed the design pressure of the overall refrigeration system. In order to prevent any pressure building up in tank 150, it may be beneficial to provide power to one or more compressors 141 to alleviate or limit any pressure build up in tank 150. In general operation, system 100 comprises an emergency electric power supply 110 that may be used during a power outage, or any time that utility power 101 may be limited. Power switch 130 may control the power delivered to controller 120 and/or motor drives 140 from emergency electric power supply 110. By providing power to components of system 100 that are regularly utilized and maintained, resources may be saved rather than used on additional components (e.g., backup compressors to be used during a power outage).

Emergency electric power supply 110 may supply power to refrigeration system 100. In some embodiments, emergency electric power supply 110 may be used if there is an issue with utility power 101. For example, emergency electric power supply 110 may include one or more generators that are automatically switched on in the case of a power outage. In some embodiments, controller 120 may determine the amount of power supplied by emergency electric power supply 110. For example, controller 120 may have saved in its memory (e.g., memory 620 of FIG. 4) the amount of power provided by emergency electric power supply). As additional examples, controller 120 may determine the wattage or voltage available, the total amount of power available (e.g., over what period of time the power may be supplied), and/or the number of generators available. For example, controller 120 may determine the amount of power available from one generator. However, if a user or operator requires additional support during the power outage, an additional generator may be brought in and/or turned on. That would allow controller 120 to determine the additional amount of power available, and provide additional compression to refrigerant and/or provide refrigeration during the power outage.

Power switch 130 may route power from emergency electric power supply 110 to controller 120 and motor drives 140. Power switch 130 may be used when there is an issue with utility power 101, such as a power outage. Power switch 130 may indicate or communicate to controller 120 (e.g., indicated by the dashed lines in FIG. 1) that system 100 has experienced a power outage and that emergency electric power supply 110 should be used.

Motor drives 140 may include various components that interact with the refrigerant, including compressors 141, gas cooler 142, bypass valve 143, and expansion valve 144. Gas cooler 142 may cool the gas and lead the refrigerant to expansion valve 144, which controls the flow of refrigerant and can reduce the pressure of refrigerant. Bypass valve 143 may be used to bypass gas cooler 142 when its benefits are not needed for the refrigerant. Each of the motor drives 140 may receive signals or instructions from controller 120 to turn on, and uses the power delivered by power switch 130 from emergency electric power supply 110, in order to turn on.

As discussed above, refrigeration system 100 includes one or more compressors 141. One or more compressors 141 compress the refrigerant in tank 150 so that the system can recirculate the cooled, liquid refrigerant to keep the refrigeration load cool. Refrigeration system 101 may include any suitable number of compressors 141. By including additional compressors, it reduces the amount of compression that other compressors need to apply to refrigerant. Compressors 141 may vary by design and/or by capacity. In some embodiments, there may be two groups of compressors 141. For example, one group of compressors 141 may be powered directly by main distribution panel 103, while a second group of compressors 141 may normally be powered by main distribution panel 103 through power switch 130. This second group of compressors (e.g., those powered through power switch 130) may be the group used during a power outage, because they can still receive power from emergency electric power supply 110 through power switch 130, while the first group of compressors 141 may be unavailable because utility power 101 is experiencing issues. This design of having on compressor group powered through power switch 130 allows for compressors 141 to still be available for use during a power outage by being powered by emergency electric power supply 110.

Tank 150 may store refrigerant used to cool an area around system 100. This disclosure contemplates tank 150 storing refrigerant in any state such as, for example, a liquid state and/or a gaseous state. In some embodiments, the refrigerant may be carbon dioxide, which can increase the pressure on tank 150 if it is not kept cool. One or more compressors 141 may compress the refrigerant such that it lessens the pressure in tank 150.

Refrigeration system 100 may include at least one controller 120 in some embodiments. Controller 120 may be configured to direct the operations of the refrigeration system. Controller 120 may be communicatively coupled to one or more components of the refrigeration system (e.g., motor drives 140, compressors 141, gas coolers 142, bypass valve 143, expansion valve 144, and power switch 130). As illustrated in FIG. 1, the controller 120 is communicatively coupled to the various components of system 100, as illustrated by the dashed lines. In some embodiments, the connections therebetween are through a wired-connection. A conventional cable and contacts may be used to couple the controller 120 to the various components of system 100 via the controller interface. In other embodiments, a wireless connection may also be employed to provide at least some of the connections.

Controller 120 may be configured to control the operations of one or more components of refrigeration system 101. For example, controller 120 may be configured to turn compressors 141 on and off. As another example, controller 120 may be configured to determine when system 100 is using emergency electric power supply 100. As another example, controller 100 may be configured to determine an amount of power to supply to the first compressor based on the first power outage mode.

In some embodiments, controller 120 may further be configured to receive information about the refrigeration system from one or more sensors. As an example, controller 120 may receive information about the ambient temperature of the environment (e.g., outdoor temperature) from one or more sensors. As another example, controller 120 may receive information about the system load from sensors associated with compressors 141. As yet another example, controller 120 may receive information about the temperature and/or pressure of the refrigerant from sensors positioned at any suitable point(s) in the refrigeration system.

As described above, controller 120 may be configured to provide instructions to one or more components of the refrigeration system. Controller 120 may be configured to provide instructions via any appropriate communications link (e.g., wired or wireless) or analog control signal. As depicted in FIG. 1, controller 120 is configured to communicate with components of the refrigeration system. For example, in response to receiving an instruction from controller 120, the refrigeration system may turn on one or more motor drives 140, such as one or more compressors 141. In some embodiments, controller 120 includes or is a computer system.

In operation, if system 100 suffers from a power outage, it may be desirable to supply a limited amount of power to system 100 such that it can prevent its components from damages and/or provide limited refrigeration. In operation, system 100 may have a first power outage mode in which controller 120 uses power from emergency electric power supply 110 in order to run a sufficient number of compressors 141 such that the pressure of refrigerant in tank 150 remains at an acceptable level (e.g., there is no risk of over pressurizing tank 150). System 100 may also have a second power outage mode in which controller 120 uses power from emergency electric power supply 110 to run an additional number of compressors 141 and/or motor drives 140 such that system 100 may continue to deliver refrigeration. System 100 may also include a second power outage mode, which indicates to controller 120 what components should be turned on and for how long to ensure sufficient refrigeration. Having a second power outage mode that can supply refrigeration in a power outage may protect from overheating certain people, products, or components that system 100 is intended to cool. The operation of system 100 is described in further detail below with respect to FIGS. 2 and 3.

This disclosure recognizes that a refrigeration system, such as system 100 depicted in FIG. 1, may comprise one or more other components. As an example, the refrigeration system may comprise one or more condensers or humidity sensors in some embodiments. Some systems may include a booster system with ejectors and parallel compression. One of ordinary skill in the art will appreciate that the refrigeration system may include other components not mentioned herein.

FIG. 2 is a flowchart illustrating method 200 of operating the example refrigeration system 100 of FIG. 1. In particular embodiments, various components of system 100 perform the steps and method 200.

The method may begin at step 201. At step 201, in some embodiments, controller 120 determines whether system 100 is using emergency electric power supply 110. In some embodiments, controller 120 receives an indication from power switch 130 that system 100 is using emergency electric power supply 110. When a power outage occurs, a separate system may automatically turn on emergency electric power supply 110, which may automatically activate power switch 130 as well. Because power switch 130 and controller 120 are communicatively coupled, controller 120 may recognize that power switch 130 is being utilized and determine that system 100 has incurred a power outage, and thus it is using emergency electric power supply 110 to operate. In some embodiments, emergency electric power supply 110 allows system 100 to operate in a limited manner, for example, to prevent tank 150 from becoming over pressurized.

At step 203, in some embodiments, controller 120 operates system 100 in a first power outage mode. In some embodiments, first power outage mode controls the power supplied to system 100 when system 100 experiences a power outage. System 100 may supply just enough power such that one or more compressors 141 may compress the refrigerant in tank 150 such that it keeps the pressure under control. For example, first power outage mode may allow one compressor 141 to turn on and compress refrigerant in tank. This amount of compression may keep the pressure in tank 150 at a normal level until utility power 101 is revived. First power outage mode may control which of the multiple compressors 141 are turned on, the length of time they are turned on for, and whether the compressors are sequenced (e.g., one is turned on for a period of time, then another is turned on for another period of time while the first one is turned off). First power outage mode is used when refrigeration is not required during a power outage, and the primary concern includes keeping the refrigerant in tank 150 at an appropriate amount of pressure.

At step 205, in some embodiments, controller 120 determines an amount of power to supply the first compressor (e.g., compressor 141) based on the first power outage mode. In the example used above, if first power outage mode requires one compressor (e.g., one of compressors 141) to be turned on, controller 120 may determine the amount of power to supply for one compressor to operate. By determining the amount of power required, controller 120 may compare to the amount of power available to ensure that compressor 141 may be safely and adequately operated during the power outage. In some embodiments, controller 120 may determine that the power available from emergency electric power supply 110 is not a sufficient amount to power one or more compressors 141 as dictated by the first power outage mode. When this occurs, controller 120 may send a signal to indicate, for example to an operator or user, that there is an insufficient power supply and the tank 150 may suffer from a large amount of pressure. In some embodiments, controller 120 may omit this step because system 100 is designed to have sufficient power to turn on compressor 141, and thus controller 120 may immediately turn on compressor 141, as described below at step 207.

At step 207, in some embodiments, controller 120 transmits a signal to instruct compressor 141 to turn on. Controller 120 may transmit the signal either through a wired or wireless communication. By turning on compressor 141, controller 120 ensures that it will compress refrigerant in tank 150 and maintain an adequate pressure. In some embodiments, controller 120 may transmit a signal to more than one compressor 141. In some embodiments, controller 120 may further turn on other motor drives 140 to ensure compressor 141 may adequately maintain the refrigerant in tank 150.

At step 209, in some embodiments, controller 120 transmits an indication for display that system 100 is in the first power outage mode. The indication that system 100 is in the first power outage mode may be displayed on an interface such that a user, operator, or maintenance person may be able to tell what mode. This may be useful for the user to know that, although there is a power outage, system 100 is operating safely and ensuring the pressure in tank 150 is at an adequate level. In some embodiments, the user may input the specific mode the user would like system 100 to operate at. For example, system 100 may not switch to first power outage mode without an indication from the user through the interface and/or display. In some embodiments, a user may instruct system 100 to operate in a different mode, as explained below. After transmitting an indication for display that system 100 is in the first power outage mode, the method ends.

Modifications, additions, or omissions may be made to method 200 depicted in FIG. 2. Method 200 may include more, fewer, or other steps. For example, steps may be performed in parallel or in any suitable order, and steps may be omitted. While discussed as various components of refrigeration system 100 performing the steps, any suitable component or combination of components of system 100 may perform one or more steps of the method.

FIG. 3 is a flowchart illustrating method 300 of operating the example refrigeration system 100 of FIG. 1. In particular embodiments, various components of system 100 perform the steps and method 200.

At step 301, in some embodiments, controller 120 determines whether the system is using emergency electric power supply 110. For example, a power outage may render utility power 101 unusable, and thus system 100 has automatically switched to using backup power and/or generators in emergency electric power supply 110. In some embodiments, one or more aspects of step 301 may be implemented using one or more techniques discussed above with respect to step 201 of method 200 illustrated in FIG. 2. If controller 120 determines that system 100 is using emergency electric power supply 110, it can determine to operate a second power outage mode, wherein system 100 provides refrigeration (rather than first power outage mode described in FIG. 2) in two different ways. First, controller 120 may determine to operate in second power outage mode if it receives an instruction to do so (as explained in step 303 below). Second, controller 120 may determine to operate in second power outage mode if it determines there is a sufficient amount of power available from emergency electric power supply 110 (as explained in step 307 below).

At step 303, in some embodiments, controller 120 determines whether it has received an instruction to operate in a second power outage mode. Controller 120 may receive this instruction from a user's interaction with an interface (e.g., wall display, computer, and/or mobile device). In some embodiments, the user may interact with a display to select the second power outage mode (e.g., override the system's automatic selection of the first power outage mode. In some embodiments, second power outage mode allows for system 100 to provide cooling or refrigeration, rather than simply maintain the pressure in tank 150 as in first power outage mode. For example, a user may own a grocery store and notice that there is a power outage. Because the meat section of his grocery store contains very valuable selections that the user does not wish to spoil during the power outage, the user may choose to provide a limited amount of refrigeration during the power outage. Continuing the example, the user may bring in or already have an additional backup power supply to help provide refrigeration, and then select the second power outage mode. In some embodiments, the second power outage mode may provide instructions to controller 120 on the amount of refrigeration to provide (e.g., low load, medium load, and/or high load), and certain areas of a store or building to provide the cooling to (e.g., meat section of a grocery store, server room of an office).

At step 305, in some embodiments, controller 120 determines whether a second compressor (e.g., one of compressors 141) may be turned on based on the second power outage mode. Controller may access set requirements for the second power outage mode, for example in memory 620 of FIG. 4, to determine what components may be turned on based on that mode. In some embodiments, second power outage mode requires other components (e.g., motor drives 14) to be turned on, rather than an additional compressor 141. If controller 120 determines that second compressor 141 may be turned on, the method continues to step 313 where the second compressor 141 is turned on, as discussed below. If controller 120 determines that the second compressor 141 may not be turned on based on the second power outage mode, the method continues to step 307.

At step 307, in some embodiments, controller 120 determines an amount of power available from emergency electric power supply 110. Controller 120 may determine this information using variables and logic stored in its memory 620 (e.g., memory may indicate an amount of power available during a power outage). In some embodiments, controller 120 determines the power available (e.g., wattage, voltage) for a period of time and/or the number of generators available. For example, controller 120 may know (e.g., stored in memory 620) the amount of power available from one generator, and using the number of generators available, then determine the total amount of power available from emergency electric power supply 110.

At step 309, in some embodiments, controller 120 determines a second power outage mode based on the amount of power available. The second power outage mode may indicate and control what components may be turned on (e.g., compressors 141, gas cooler 142) while operating in this mode, and for how long. At step 311, in some embodiments, controller 120 determines whether second compressor 141 can be turned on based on the second power outage mode. If controller 120 determines a second compressor 141 cannot be turned on, then the method ends. If controller 120 determines second compressor 141 can be turned on, the method continues to step 313. At step 313, in some embodiments, controller 120 transmits a signal to instruct second compressor 141 to turn on. In some embodiments, one or more aspects of step 313 may be implemented using one or more techniques discussed above with respect to step 207 of method 200 illustrated in FIG. 2.

At step 315, in some embodiments, controller 120 determines whether a third compressor 141 can be turned on based on the second power outage mode. Controller 120 may look at the settings for the second power outage mode (e.g., settings stored in memory 620 of controller 120) and determine how many compressors 141 may be used. Second power outage mode may also indicate the load needed to supply limited refrigeration, and thus controller 120 may determine the number of compressors 141 required to be in use in order to supply that necessary load. In some embodiments, one or more aspects of step 315 may be implemented using one or more techniques discussed above with respect to step 311. If controller 120 determines that third compressor 141 cannot be turned on, the method ends. If controller 120 determines that third compressor 141 can be turned on, the method continues to step 317 and controller 120 transmits a signal to instruct the third compressor to turn on. In some embodiments, one or more aspects of step 317 may be implemented using one or more techniques discussed above with respect to step 313.

Steps 319-331 in general determine whether other motor drives 140 may be turned on based on the amount of power available. For example, some of these motor drives may not be necessary to provide a limited amount of cooling during a power outage, however, it may be beneficial to turn them on if there is power available. In some embodiments, the amount of power required to operate these motor drives 140 is so low, that controller 120 determines they should be turned on regardless of the power supply. In some embodiments, controller generally determines whether there is sufficient power, and if so, turns on one or more motor drive components. These steps are described in more detail below.

At step 319, in some embodiments, controller 120 determines the amount of power available from emergency electric power supply 110. Controller 120 may determine the amount that is not currently in use, for example, the amount not being used by a first, second, and/or third compressor 141 that may have already been switched on. In some embodiments, one or more aspects of step 319 may be implemented using one or more techniques discussed above with respect to step 307. At step 321, in some embodiments, controller 120 determines whether the power calculated in step 319 is sufficient to turn on gas cooler 142. Controller 120 may determine the total amount of power required to keep gas cooler 142 operating for a certain period of time. If controller 120 determines there is insufficient power, the method ends. If controller 120 determines there is enough power, then at step 323, controller 120 transmits a signal to instruct gas cooler 142 to turn on. In some embodiments, one or more aspects of step 323 may be implemented using one or more techniques discussed above with respect to steps 313 and 317.

At step 325, in some embodiments, controller 120 determines whether there is sufficient power to turn on expansion valve 143. Controller 120 may recalculate the remaining power, for example, if it turned on gas cooler 142 in step 321 and thus the power supply available is lower than the amount previously determined at step 319. In some embodiments, one or more aspects of step 325 may be implemented using one or more techniques discussed above with respect to step 321. If controller 120 determines there is sufficient power at step 325, then at step 327, controller 120 transmits a signal to instruct expansion valve 144 to turn on. In some embodiments, one or more aspects of step 327 may be implemented using one or more techniques discussed above with respect to steps 313, 317, and 323.

At step 329, in some embodiments, controller 120 determines whether there is sufficient power to turn on bypass valve 143. In some embodiments, one or more aspects of step 329 may be implemented using one or more techniques discussed above with respect to steps 321 and 325. If controller 120 determines there is insufficient power, then the method ends. If controller 120 determines there is sufficient power, then at step 331, controller 120 transmits a signal to instruct bypass valve to turn on. In some embodiments, one or more aspects of step 327 may be implemented using one or more techniques discussed above with respect to steps 313, 317, 323, and 327. Then the method ends.

Modifications, additions, or omissions may be made to method 300 depicted in FIG. 3. Method 300 may include more, fewer, or other steps. For example, steps may be performed in parallel or in any suitable order, and steps may be omitted. While discussed as various components of cooling system 100 performing the steps, any suitable component or combination of components of system 100 may perform one or more steps of the method.

Figure 4:
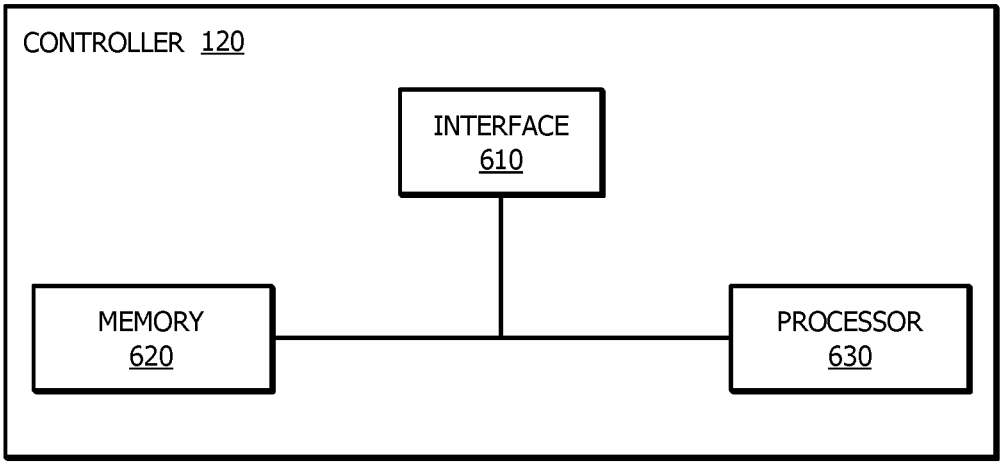
FIG. 4 illustrates an example of a controller of a refrigeration system, according to certain embodiments.

FIG. 4 illustrates an example controller 120 for a refrigeration system, such as controller 120 of FIG. 1, according to certain embodiments of the present disclosure. Controller 120 may comprise one or more interfaces 610, memory 620, and one or more processors 630. Interface 610 receives input (e.g., sensor data or system data), sends output (e.g., instructions), processes the input and/or output, and/or performs other suitable operation. Interface 610 may comprise hardware and/or software. As an example, interface 610 receives information from sensors, such as information about the ambient temperature of refrigeration system, information about the load of the refrigeration system, information about the temperature of the refrigerant at any suitable point(s) in the refrigeration system, and/or information about the pressure of the refrigerant at any suitable point(s) in the refrigeration system (e.g., pressure of tank 150). Controller 120 may determine whether system 100 of FIG. 1 is using emergency electric power supply 110, for example, due to a power outage. In some embodiments, controller 120 sends instructions to the component(s) of the refrigeration system that controller 120 has may want to power on and/or adjust (e.g., compressor(s) 141, gas cooler 142, bypass valve 143, expansion valve 144, etc.).

Processor 630 may include any suitable combination of hardware and software implemented in one or more modules to execute instructions and manipulate data to perform some or all of the described functions of controller 120. In some embodiments, processor 610 may include, for example, one or more computers, one or more central processing units (CPUs), one or more microprocessors, one or more applications, one or more application specific integrated circuits (ASICs), one or more field programmable gate arrays (FPGAs), and/or other logic.

Memory (or memory unit) 620 stores information. As an example, memory 620 may store information about different power outage modes, specifically the settings to apply to one or more motor drives 140 (e.g., to compressor(s) 141) during a power outage. Memory 620 may comprise one or more non-transitory, tangible, computer-readable, and/or computer-executable storage media. Examples of memory 620 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, the refrigeration system may include any suitable number of compressors 141, gas coolers 142, bypass valves, 143, expansion valves 144, tanks 150, controllers 120, power switches 130, and emergency electric power supplies 110, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A refrigeration system, comprising:

an emergency electric power supply configured to supply power to at least one motor drive of the refrigeration system;

a power switch coupled to the emergency electric power supply;

a tank configured to store a refrigerant;

a first compressor configured to compress the refrigerant of the tank;

a controller coupled to the power switch and the first compressor, the controller configured to:

receive an indication from the power switch that the system is using the emergency electric power supply;

in response to receiving the indication from the power switch that the refrigeration system is using the emergency electric power supply, determine an amount of power available from the emergency electric power supply;

determine, based on the amount of power available from the electric power supply, at least one power outage mode in which to operate the refrigeration system, the at least one power outage mode indicating which components of the refrigeration system to turn on during use of the emergency electric power supply;

following determining the at least one power outage mode, transmit a first signal to instruct the first compressor to turn on.

2. The refrigeration system of claim 1, wherein the determined at least one power outage mode is a first power outage mode associated with maintaining a pressure in the tank at or above a minimum pressure during use of the emergency electric power supply; and wherein the controller is further configured to:

in response to receiving the indication from the power switch that the system is using the emergency electric power supply, operate the system in the first power outage mode; and determine an amount of power to supply to the first compressor based on the first power outage mode.

3. The refrigeration system of claim 2, further comprising a second compressor, the second compressor configured to compress the refrigerant of the tank, wherein the determined at least one power outage mode is a second power outage mode associated with providing continued refrigeration during use of the emergency electric power supply, and wherein the controller is further configured to:

determine a first remaining amount of power available from the emergency electric power supply while the first compressor is turned on;

determine whether the second compressor may be turned on based on the first remaining amount of power; and in response to determining that the second compressor may be turned on, transmit a second signal to instruct the second compressor to turn on.

4. The refrigeration system of claim 3, further comprising a third compressor, the third compressor configured to compress the refrigerant of the tank, and wherein the controller is further configured to:

determine a second remaining amount of power available from the emergency electric power supply while the first and second compressors are turned on;

determine whether the third compressor may be turned on based on the second remaining amount of power; and in response to determining that the third compressor may be turned on, transmit a third signal to instruct the third compressor to turn on.

5. The refrigeration system of claim 1, further comprising:

a gas cooler coupled to the controller and the tank;

an expansion valve coupled to the controller and the tank;

a bypass valve coupled to the controller and the tank; and wherein the controller is further configured to:

determine a remaining amount of power available from the emergency electric power supply while the first compressor is turned on;

based on the remaining amount of power available, determine whether to turn on one or more of the gas cooler, the expansion valve, and the bypass valve;

in response to determining to turn on the gas cooler, transmit a second signal to instruct the gas cooler to turn on;

in response to determining to turn on the expansion valve, transmit a third signal to instruct the expansion valve to turn on; and in response to determining to turn on the bypass, transmit a fourth signal to instruct the bypass valve to turn on.

6. The refrigeration system of claim 2, wherein the controller is further configured to transmit an indication for display that the refrigeration system is in the first power outage mode.

7. The refrigeration system of claim 2, further comprising a second compressor, the second compressor configured to compress the refrigerant of the tank, and wherein the controller is further configured to:

receive an instruction to operate in a second power outage mode associated with providing continued refrigeration during operation in the second power outage mode;

determine a remaining amount of power available from the emergency electric power supply while the first compressor is turned on;

determine whether the second compressor may be turned on based on the remaining amount of power; and in response to determining that the second compressor may be turned on, transmit a second signal to instruct the second compressor to turn on.

8. A controller for a refrigeration system, comprising:

a memory;

an interface communicatively coupled to the memory, the interface configured to:

receive an indication from a power switch that the refrigeration system is using an emergency electric power supply; and a processor communicatively coupled to the memory and the interface, the processor configured to:

in response to the interface receiving the indication from the power switch that the refrigeration system is using the emergency electric power supply, determine an amount of power available from the emergency electric power supply;

determine, based on the amount of power available from the electric power supply, at least one power outage mode in which to operate the refrigeration system, the at least one power outage mode indicating which components of the refrigeration system to turn on during use of the emergency electric power supply;

the interface further configured to, following determination of the at least one power outage mode by the processor, transmit a first signal to instruct a first compressor to turn on.

9. The controller of claim 8, wherein the determined at least one power outage mode is a first power outage mode associated with maintaining a pressure in the tank at or above a minimum pressure during use of the emergency electric power supply; the processor further configured to:

in response to the interface receiving the indication from the power switch that the refrigeration system is using the emergency electric power supply, operate the refrigeration system in the first power outage mode; and determine an amount of power to supply to the first compressor based on the first power outage mode.

10. The controller of claim 9, wherein the determined at least one power outage mode is a second power outage mode associated with providing continued refrigeration during use of the emergency electric power supply, and wherein the processor is further configured to:

determine a first remaining amount of power available from the emergency electric power supply while the first compressor is turned on;

determine whether a second compressor may be turned on based on the first remaining amount of power; and the interface further configured to, in response to a determination by the processor that the second compressor may be turned on, transmit a second signal to instruct the second compressor to turn on.

11. The controller of claim 10, wherein the processor is further configured to:

determine a second remaining amount of power available from the emergency electric power supply while the first and second compressors are turned on;

determine whether a third compressor may be turned on based on the second remaining amount of power; and the interface further configured to, in response to a determination by the processor that the third compressor may be turned on, transmit a third signal to instruct the third compressor to turn on.

12. The controller of claim 8, wherein the processor is further configured to:

determine a remaining amount of power available from the emergency electric power supply while the first compressor is turned on;

based on the remaining amount of power available, determine whether to turn on one or more of a gas cooler, an expansion valve, and a bypass valve; and the interface further configured to:

in response to determining by the processor to turn on the gas cooler, transmit a second signal to instruct the gas cooler to turn on;

in response to determining by the processor to turn on the expansion valve, transmit a third signal to instruct the expansion valve to turn on; and in response to determining by the processor to turn on the bypass, transmit a fourth signal to instruct the bypass valve to turn on.

13. The controller of claim 8, wherein the interface is further configured to transmit an indication for display that the refrigeration system is in the first power outage mode.

14. The controller of claim 9, wherein:

the interface is further configured to receive an instruction to operate in a second power outage mode associated with providing continued refrigeration during operation in the second power outage mode; and the processor is further configured to:

determine a remaining amount of power available from the emergency electric power supply while the first compressor is turned on;

determine whether a second compressor may be turned on based on the remaining amount of power; and the interface further configured to, in response to a determination by the processor that the second compressor may be turned on, transmit a second signal to instruct the second compressor to turn on.

15. A non-transitory computer readable medium comprising instructions which, when executed by a computer, cause the computer to:

receive an indication from a power switch that a refrigeration system is using an emergency electric power supply;

in response to receiving the indication from the power switch that the refrigeration system is using the emergency electric power supply, determine an amount of power available from the emergency electric power supply;

determine, based on the amount of power available from the electric power supply, at least one power outage mode in which to operate the refrigeration system, the at least one power outage mode indicating which components of the refrigeration system to turn on during use of the emergency electric power supply;

following determining the at least one power outage mode, transmit a first signal to instruct a first compressor to turn on.

16. The non-transitory computer readable medium of claim 15, wherein the determined at least one power outage mode is a first power outage mode associated with maintaining a pressure in the tank at or above a minimum pressure during use of the emergency electric power supply, the non-transitory computer readable medium further comprising instructions which, when executed by a computer, cause the computer to:

in response to receiving the indication from the power switch that the refrigeration system is using the emergency electric power supply, operate the refrigeration system in the first power outage mode; and determine an amount of power to supply to the first compressor based on the first power outage mode.

17. The non-transitory computer readable medium of claim 16, wherein the determined at least one power outage mode is a second power outage mode associated with providing continued refrigeration during use of the emergency electric power supply, the non-transitory computer readable medium further comprising instructions which, when executed by a computer, cause the computer to:

determine a first remaining amount of power available from the emergency electric power supply while the first compressor is turned on;

determine whether a second compressor may be turned on based on the first remaining amount of power; and in response to determining that the second compressor may be turned on, transmit a second signal to instruct the second compressor to turn on.

18. The non-transitory computer readable medium of claim 17, further comprising instructions which, when executed by a computer, cause the computer to:

determine a second remaining amount of power available from the emergency electric power supply while the first and second compressors are turned on;

determine whether a third compressor may be turned on based on the second remaining amount of power; and in response to determining that the third compressor may be turned on, transmit a third signal to instruct the third compressor to turn on.

19. The non-transitory computer readable medium of claim 16, further comprising instructions which, when executed by a computer, cause the computer to transmit an indication for display that the refrigeration system is in the first power outage mode.

20. The non-transitory computer readable medium of claim 16, further comprising instructions which, when executed by a computer, cause the computer to:

in response to receiving an instruction to operate in a second power outage mode associated with providing continued refrigeration during operation in the second power outage mode;

determine a remaining amount of power available from the emergency electric power supply while the first compressor is turned on;

determine whether the second compressor may be turned on based on the remaining amount of power; and in response to determining that the second compressor may be turned on, transmit a second signal to instruct the second compressor to turn on.

* * * * *